US006021522A

United States Patent [19]

Najarian

[11] Patent Number: 6,021,522

[45] Date of Patent: Feb. 8, 2000

[54] NECKTIE KNOT SUPPORT ASSEMBLY

[76] Inventor: John Najarian, c/o Eastern Creative Industries, Inc., 257 Herbert Ave., Closter, N.J. 07624

[21] Appl. No.: 09/124,382

[22] Filed: Jul. 28, 1998

[51] Int. Cl.[7] ..... A41D 25/08; A41D 25/02

[52] U.S. Cl. ..... 2/153; 2/150

[58] Field of Search ..... 2/150, 153, 152.1, 2/145

[56] References Cited

U.S. PATENT DOCUMENTS

| | | | |
|---|---|---|---|
| 2,798,226 | 7/1957 | Kanter . | |
| 3,173,149 | 3/1965 | Cosgrove | 2/150 |
| 3,220,015 | 11/1965 | Kanter et al. . | |
| 3,221,343 | 12/1965 | Phillips et al. | 2/153 |
| 3,222,684 | 12/1965 | Kanter et al. . | |
| 3,237,208 | 3/1966 | Kanter et al. . | |
| 3,336,600 | 8/1967 | Kanter et al. . | |
| 3,336,601 | 8/1967 | Kanter et al. . | |
| 3,343,176 | 9/1967 | Kanter et al. . | |
| 3,365,726 | 1/1968 | Pulitizer | 2/153 |
| 3,426,361 | 2/1969 | Ellin . | |
| 3,513,483 | 5/1970 | Kanter et al. . | |
| 3,820,166 | 6/1974 | Gouner | 2/150 |
| 4,337,539 | 7/1982 | Najarian | 2/153 |
| 4,489,443 | 12/1984 | Ellin . | |
| 4,897,887 | 2/1990 | Chen et al. | 2/150 |
| 5,084,916 | 2/1992 | Austin . | |
| 5,505,351 | 4/1996 | Najarian . | |

*Primary Examiner*—John J. Calvert
*Assistant Examiner*—Tejash D Patel
*Attorney, Agent, or Firm*—McAulay Nissen Goldberg Kiel & Hand, LLP

[57] ABSTRACT

A necktie knot support assembly that supports a pre-tied knotted necktie which, when worn, advantageously provides a knot that is maintained away from the wearer's neck, so as to aesthetically resemble a non pre-tied necktie. The assembly includes a main body member that is shaped to determine the formation of the knot of the necktie, and a spring clamp that is adapted to inter-engage the main body member. The main body member has a central wall and a post that rearwardly extends outwards from the wall at an acute angle therefrom. The main body member is shaped to integrally include left and right wings that extend outward from the central wall and that preferably have respective top surfaces that extend outwardly in a substantially horizontal plane relative to the central wall. The main body member further preferably includes an integrally connected forwardly projecting nose portion. In addition, instead of including a post that extends away from the rear of the body member, the body member may include, integral therewith, a rear support member that abridges across the rear surface of the wall. The rear support member may extend from the central wall at an acute angle therefrom and includes a notch that is adapted to receive a portion of the necktie so that the necktie is retained on the assembly. A rectangular-shaped slot may be formed between the rear support member and the rear surface of the wall so that the assembly can be mounted on a jig via the slot, thus facilitating the tying of a necktie on the assembly.

18 Claims, 3 Drawing Sheets

NECKTIE KNOT SUPPORT ASSEMBLY

BACKGROUND OF THE INVENTION

The present invention relates to improvements in necktie knot support assemblies which serve as a mechanical foundation for receiving and fixing of a fabric necktie, to be wrapped there around, so that the ultimate composite product serves as a pre-tied necktie, with a spring clamp enabling the user to simply apply the pre-tied necktie to a shirt collar neck band or the like.

Pre-tied neckties have been available for many decades. Such neckties provided with a spring clamp for firmly grasping the shirt neck band have also been used as well as patented for several decades. Earlier designs are disclosed in the following U.S. Pat. Nos. 2,798,226; 3,220,015; 3,222,684; 3,237,208; 3,336,600; 3,336,601 and 3,343,176. A more modem pre-tied necktie is disclosed in U.S. Pat. No. 4,337,539, which is incorporated herein by reference.

Currently, all pre-tied neckties, including those disclosed in the above-mentioned patents, have the same drawback: they all have a knot that sags inwards towards the neck. This sag is an undesirable indication that the wearer is wearing a pre-tied necktie, which also is known as a clip-on tie.

OBJECTS AND SUMMARY OF THE INVENTION

It is therefore an object of the present invention to provide a necktie knot support assembly which overcomes the above-stated drawback of existing designs.

Another object of the present invention is to accomplish the above objective while providing additional advantageous features including an improved knot shape as well as a design that facilitates the assembling of a necktie thereon.

In accordance with one embodiment of the present invention, a necktie knot support assembly for supporting a pre-tied knotted necktie is comprised of a main body member shaped to determine formation of the knot of the necktie, and a spring clamp that is adapted to inter-engage the main body member. The main body member has a substantially vertical central wall and a post that rearwardly extends outwards from the wall at an acute angle therefrom.

As an aspect of the invention, the spring clamp is adapted to inter-engage the main body member at a position that is adjacent to and in vertical alignment with the wall.

As another aspect of the invention, the main body member includes two wings that extend outwards from the wall of the main body member in a substantially horizontal plane relative to the vertical central wall.

As a feature of this aspect, each of the two wings includes a top surface that extends from the wall in the substantially horizontal plane.

As an additional aspect of the invention, the spring clamp includes a swingable clamp aim that is operatively swingable between opened and closed positions. The swingable clamp arm includes two ends, one end that is swingably coupled to the spring clamp at a position that is above the top of the vertical central wall of the main body, and the other end is adapted to engage the outer end of the post in the closed position.

As a feature of this aspect, the two wings extend outwards from the wall of the main body member in respective planes that are located below the position at which the swingable clamp is swingably coupled to the spring clamp.

As yet another aspect of the invention, the main body member includes a substantially forwardly projecting nose portion.

In accordance with another embodiment of the present invention, the necktie knot support assembly is comprised of a main body member that has a substantially vertical central wall and a rear support member that abridges across the rear surface of the wall, and a spring clamp that is adapted to inter-engage the main body member.

As an aspect of this embodiment, the rear support member extends from the vertical central wall at an acute angle therefrom.

As another aspect of this embodiment, the rear support member includes a notch that is adapted to receive a portion of the necktie so as to retain the necktie on the assembly.

As a further aspect of this embodiment, a rectangular shaped slot is formed between the rear support member and the rear surface of the wall, wherein the slot is adapted to receive a jig to facilitate mounting of the assembly on the jig.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

Figure 1:
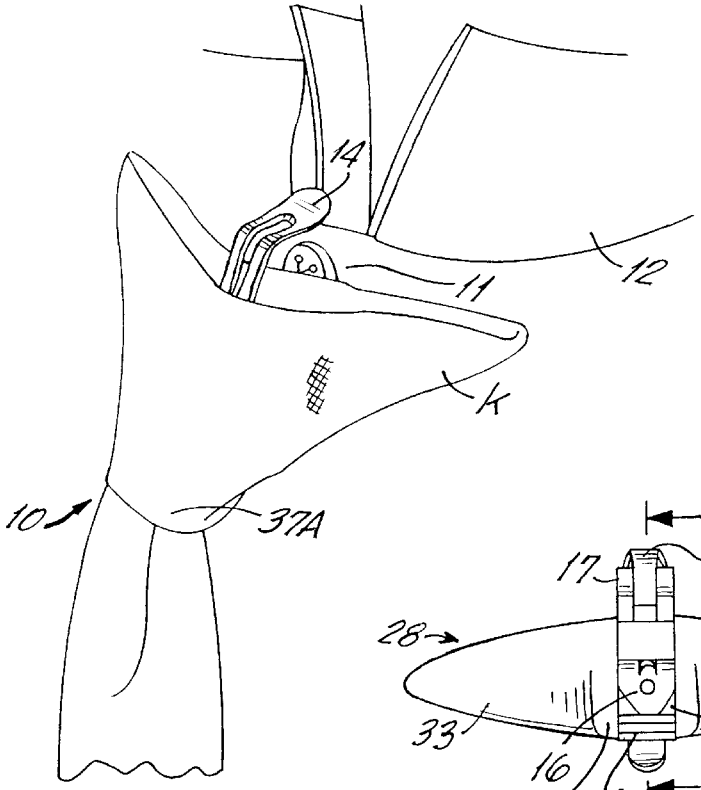
FIG. 1 is a front perspective view of a completely pre-tied necktie, the lower fabric being partly broken away, illustrating the application to a shirt neck band.
Figure 2:
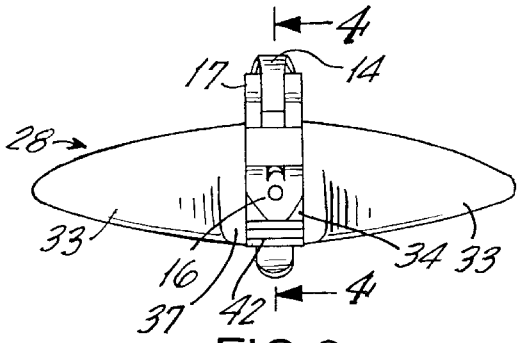
FIG. 2 is a front elevational view of the knot support assembly in accordance with a first embodiment of the present invention.
Figure 4:
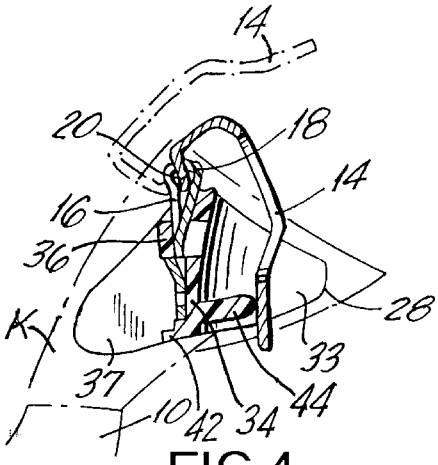
FIG. 4 is a side elevational view of the knot support assembly taken along the line 4—4 of FIG. 2.
Figure 6:
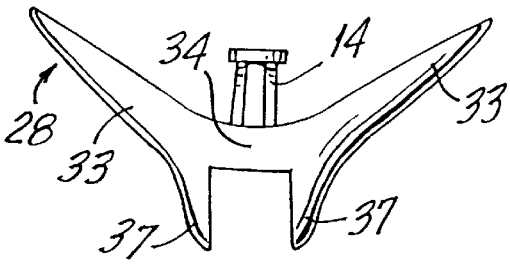
FIG. 6 is a bottom plan view of the necktie knot support assembly.
Figure 7:
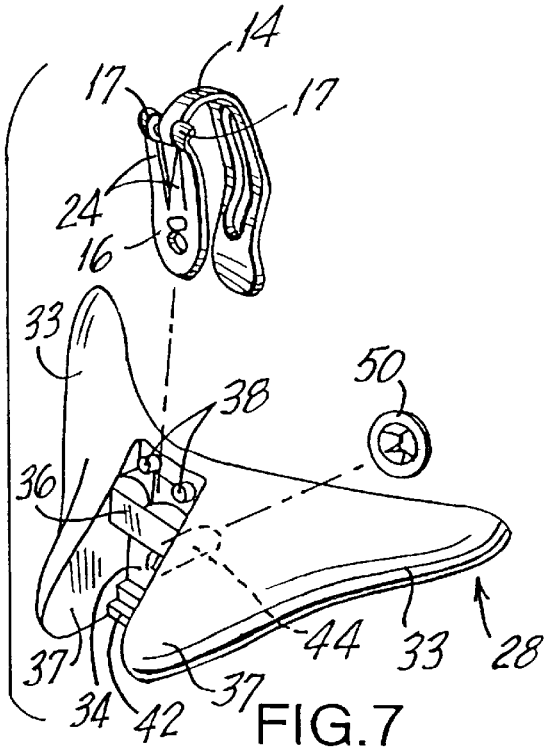
FIG. 7 is an exploded perspective view of the knot forming assembling components.

Referring now to the drawings, FIGS. 1–7 illustrate a necktie knot support assembly in accordance with a first embodiment of the present invention. Referring first to FIG. 1, a fully assembled pre-tied necktie 10, partially broken away at its bottom end, is illustrated. A formed knot K is attachable to and releasable from a neck band 11 of a shirt collar 12, the shirt collar being illustrated as being lifted for purposes of clarity, although normally it remains in the conventional downward, wearing position. Necktie 10 is applied to neck band 11 by a swingable clamp arm 14 which forms the upper portion of a spring clamp 16 (not shown in FIG. 1). As shown in FIGS. 2, 4 and 7, the upper portion of spring clamp 16 includes forward concave knuckles 17, a rearward central knuckle 18, and a rectangular cross bar 20 that is integral with and forms the extreme inner end of clamp arm 14. These elements constitute means for swingably supporting the clamp arm 14 in a vertical plane since cross bar 20 is received between knuckles 17 and 18, as shown in FIG. 4. FIG. 4 illustrates clamp arm 14 in both the opened (clamp arm 14 is shown as the dashed lines) and the closed (solid lines) positions. Spring clamp 16 including swingable clamp arm 14, as shown in FIGS. 1–7, as well as in FIGS. 8–10 herein, are substantially similar to the spring clamp 16 and clamp arm 14 shown and described in U.S. Pat. No. 4,337,539.

The present invention substantially differs from that disclosed in U.S. Pat. No. 4,337,539 in the design of its main body member 28. Main body member 28 is shown in FIGS. 2–4 and 6–7 and is hidden in FIGS. 1 and 5. As will be seen, the particular shape of main body member 28 is substantially different from that of prior designs. Prior art body members, which normally are fabricated by molding somewhat resilient polymer plastic material such as polyethylene or the like, include conventional rearwardly directed side wings that project substantially upwards, such as shown in the drawings of U.S. Pat. No. 4,337,539. These side wings are connected by a central relatively flat integral bridging wall, such wall having been devised to couple to the spring clamp. Due to this particular prior art design (i.e., the particular cooperation between the bridging wall of the main body member and the spring clamp), the design of the wings of the body member are over-accentuated and are required to extend upwards to achieve a knot with a desired appearance. This prior art design, however, disadvantageously results in a knot that sags inwards towards the wearer's neck.

In accordance with the present invention, body member 28 comprises a number of features that, when coupled to spring clamp 16, provides a knot that does not sag inwards towards the wearer's neck and provides a visual appearance more representative of a non pre-tied necktie.

Figure 3:
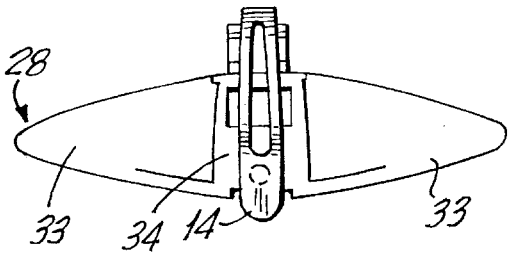
FIG. 3 is a rear elevational view thereof.
Figure 5:
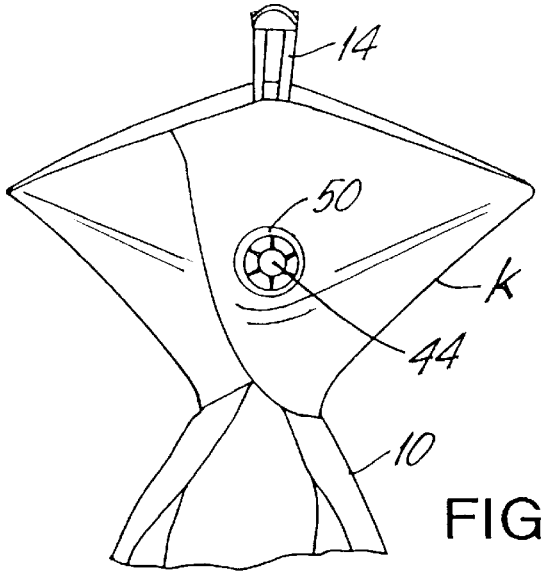
FIG. 5 is a rear elevational view of the complete pre-tied necktie, the lower fabric of the necktie being partly broken away.

Referring particularly to FIGS. 2–4, body member 28 is shown to include rearwardly directed side wings 33 that do not extend upwards. In other words, the respective top surfaces of the side wings 33 slope downwards when wall 34 is held vertically, as the wings extend out toward the wearer's neck. This is in contrast to prior art designs, which provide for wings with top surfaces that slope upwards. As best shown in FIGS. 3 and 6, side wings 33 are connected by a central, relatively flat integral bridging wall 34. Wall 34 is devised to cooperate with spring clamp 16 (see FIGS. 2, 4 and 7).

In accordance with the present invention, body member 28 includes two nose projections 37, as shown in FIGS. 6 and 7 (one nose projection 37 is shown in the side view of FIG. 4). Nose projections 37 are integrally formed with respective side wings 33. In the fully assembled pre-tied necktie, the outer most tip 37A of knot K, shown in FIG. 1, covers the outer tips of nose projections 37. As will be appreciated, tip 37A extends away from the wearer's neck during use.

As best shown in FIGS. 2 and 7, a front horizontally slotted arm 36 is integrally formed between the rearward portions of the protruding noses 37. A space is formed between slotted arm 36 and wall 34 for receiving spring clamp 16, as shown in FIG. 4. Spring clamp 16 is a thin spring metal and is easily insertable and snapable into this opening. Two molded integral short projections 38, shown in FIG. 7, serve to press against upper, outer legs 24 of clamp 16 when the clamp is inserted into position. The projections 38 are horizontally spaced. Body member 28 also includes, integrally formed therewith, a ridge 42 at a lower surface of wall 34. Ridge 42 limits further downward movements of spring clamp 16 through the opening defined by slotted arm 36.

To urge the formed knot in an elevated manner so as to avoid a flattened, unaesthetic appearance of the knot, and as best shown in FIGS. 4 and 7, a rear post 44 is integrally molded with body member 28 to extend therefrom at a direction somewhat parallel to the bottom surfaces of side wings 33. As shown in FIG. 4, post 44 extends from wall 34, not at a right angle therefrom, but at an acute angle of, for example, 70 degrees. By extending post 44 from body member 28 at the angle shown (or slight variations thereof, e.g., +/−10°), the completed necktie, when worn, is urged in such a manner so as to retain post 44 and side wings 33 in a substantially horizontal position that results in outwardly projecting nose projections 37. Nose projections 37 in turn maintain knot K in a non-sagging position away from the wearer's neck. Further, since post 44 is held substantially horizontally, spring clamp 16 and wall 34 are not held vertically, but instead, are held slanted.

As previously mentioned, side wings 33 of main body member 28 do not project upwards. This is in contrast to prior art designs which, by necessity, require upwardly extending side wings in order to hide the metal spring clasp that wraps around the shirt collar. Unlike the prior art, the present invention provides a design that advantageously results in a knot that is maintained away from the wearer's neck thus resulting in a knot, when the completed necktie is worn, that covers the otherwise visible portion of clamp arm 14. In other words, prior art designs provide a knot, when worn, that is maintained in a substantially vertical position (i.e., the spring clamp of the prior art is held vertical), whereas the present invention provides a knot that is substantially not vertical (i.e., spring clamp 16 is held at approximately a 45° angle relative to the vertical position in the present example). Thus, it is the particular orientation of the completed knot on the wearer's neck, and not the particular shape of wings 33, that results in the covering by the knot of the otherwise visible portion of spring clamp 16.

The held position of the knot in the present invention allows for a different and a more aesthetically pleasing knot shape by means of providing side wings 33 that do not extend upwards as they extend out from wall 34 of body member 28 (i.e., from the central part of the knot). When the completed necktie is worn, wings 33 extend either horizontally or fractionally downward as they extend out from wall 34. Moreover, since wings 33 do not extend upwards, there is a greater distance between the top of spring clamp 16 and the top of the wings, as compared to previous designs, thus advantageously resulting in a more secure and closer holding of the shirt collar between spring clamp 16 and clamp arm 14, further facilitating a non-sagging knot. Still further, a non-sagging knot may further be facilitated by reducing the width (thickness) of wall 34, as compared to previous designs, by at least 25% so that the shirt collar is held even closer to the assembly.

Finally, it now remains to finally form and tie a necktie to the necktie knot support assembly of the present invention, but such may be done in any conventional method, for example, by the method disclosed in U.S. Pat. No. 4,337,539. Since the formation of a necktie on a necktie knot support assembly is well known in the art, further description thereof is omitted herein. The assembly process is completed by the known installation of push-on speed nut 50 down over post 44.

Figure 8:
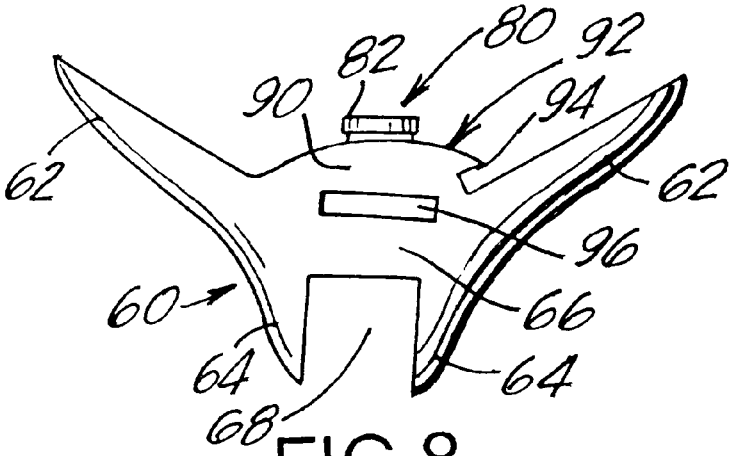
FIG. 8 is a bottom plan view of a knot support assembly in accordance with another embodiment of the present invention.
Figure 9:
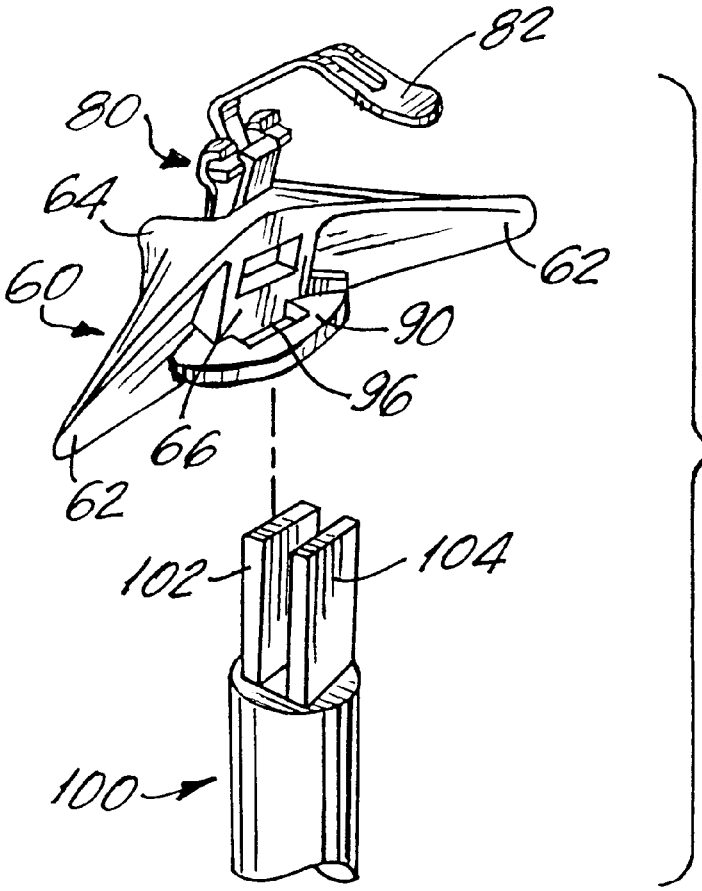
FIG. 9 is a rear perspective view of the knot support assembly shown in FIG. 8, together with a jig on which the knot support assembly may be mounted.

FIGS. 8 and 9 illustrate a necktie knot support assembly in accordance with another embodiment of the present invention. The necktie knot support assembly includes a main body member 60 and a spring clamp 80. Spring clamp 80 includes a clamp arm 82 and is identical to spring clamp 16 previously discussed.

Body member 60 includes two wings 62, two forward nose projections 64 and a bridging wall 66 that are substantially similar to wings 33, nose projections 37 and bridging wall 34, previously discussed. Although not shown in FIGS. 8 and 9, body member 60 also includes a slotted arm, projections, a ridge and a space between the slotted arm and the wall for receiving spring clamp 80. These components of body member 60 are substantially similar to the corresponding components slotted arm 36, projections 38 and ridge 42 of the body member discussed above with respect to FIGS. 1–7.

In accordance with the present invention, body member 60 further includes, integrally formed at the rear thereof a wide support member 90. Wide support member 90 extends between inner surfaces of the two wings 33 in the manner shown forming a rectangular slot 96 between itself and bridging wall 66. Wide support member 90 includes a notched end 94 at one outer end thereof and adjacent to one of the wings 62, and preferably has a curved surface 92 that receives clamp arm 82 when the clamp arm is closed over the shirt collar. While wide support member 90 may extend from bridging wall 66 at a right angle therefrom, it is preferred for wide support member 90 to extend acutely from bridging wall 66, for example, at angles of 60 to 80°, so as to achieve the advantageous feature of maintaining the completed knot away from the wearer's neck.

As can be appreciated, the second embodiment of FIGS. 8 and 9 includes wide support member 90, whereas the previously discussed embodiment includes post 44. Wide support member 90 serves a substantially similar purpose as that provided by post 44. However, wide support member 90 advantageously results in a smoother back surface of the completed necktie resulting in a more comfortable feel by the wearer as well as a more aesthetically pleasing appearance.

Notched end 94 of member 90 serves the function of maintaining a necktie on the necktie knot support assembly by means of placing a hole in an appropriate location of the necktie and then placing the notched end 94 through that hole during formation of the completed necktie. The presence of the notched end obviates the need for a speed nut or other fastening mechanism that may be required to maintain a necktie on a necktie knot support assembly.

Finally, body member 60 includes rectangular slot 96. While the formation of slot 96 is only optional, it advantageously allows for the necktie assembly to be mounted on a jig 100, shown in FIG. 9, so as to facilitate the tying of a necktie on the assembly. As shown in FIG. 8, a space 68 exists between nose projections 64 of body member 60. To mount the necktie assembly on jig 100, the assembly is lowered onto the jig so that jig extension 102 extends into space 68 and jig extension 104 extends into slot 96. Of course, space 68, slot 96 and jig extensions 102, 104 may have a shape different from that shown.

While the present invention has been particularly shown and described in conjunction with preferred embodiments thereof, it will be readily appreciated by those of ordinary skill in the art that various changes may be made without departing from the spirit and scope of the invention. For example, different latch mechanisms other than the spring latches shown may be used with the body members shown.

Therefore, it is intended that the appended claims be interpreted as including the embodiments described herein, the alternatives mentioned above, and all equivalents thereto.

What is claimed is:

1. A necktie knot support assembly for supporting a pre-tied knotted necktie, said assembly comprising:

a main body member shaped to determine formation of the knot of said necktie, said main body member having a substantially vertical central wall and a post rearwardly extending outwards from the wall at an acute angle therefrom, said acute angle being substantially between 60° and 80°, said main body member having first and second wings extending outward and sloping downward from the wall; and a spring clamp adapted to inter-engage said main body member.

2. The assembly of claim 1, wherein said spring clamp is adapted to inter-engage said main body member at a position adjacent to and in vertical alignment with the wall.

3. The assembly of claim 1, wherein said spring clamp includes a swingable clamp arm operatively swingable between an opened position and a closed position, said swingable clamp arm including first and second ends, said first end swingably coupled to said spring clamp at a position above said first and second wings, said second end adapted to engage an outer end of said post in said closed position.

4. The assembly of claim 1, wherein said main body member includes a substantially forwardly projecting nose portion, said nose portion forming a front portion of the knot of said necktie.

5. The assembly of claim 1, wherein said acute angle is substantially 70°.

6. A necktie knot support assembly for supporting a pre-tied knotted necktie, said assembly comprising:

a main body member shaped to determine formation of the knot of said necktie, said main body member having a substantially vertical central wall and a rear support member approaching horizontal and abridging across a rear surface of the wall; and a spring clamp adapted to inter-engage said main body member.

7. The assembly of claim 6, wherein said rear support member extends from said vertical central wall at an acute angle therefrom.

8. The assembly of claim 7, wherein said acute angle is substantially between 60° and 80°.

9. The assembly of claim 6, wherein a rectangular shaped slot is formed between said rear support member and said rear surface of the wall, said slot being adapted to receive a jig to facilitate mounting of said assembly on said jig.

10. The assembly of claim 6, wherein said main body member includes first and second wings extending outwards and sloping downward from the wall of said main body member.

11. The assembly of claim 6, wherein said spring clamp includes a swingable clamp arm operatively swingable between an opened position and a closed position, said swingable clamp arm including first and second ends, said first end swingably coupled to said spring clamp at a position above a top of said vertical central wall of said main body, said second end adapted to engage an outer portion of said rear support member in said closed position.

12. The assembly of claim 11, wherein said main body member includes first and second wings extending outwards and sloping downward from the wall of said main body member, each of said first and second wings being below said position at which said first end of said swingable clamp is swingably coupled to said spring clamp.

13. The assembly of claim 6, wherein said main body member includes a substantially forwardly projecting nose portion, said nose portion forming a front portion of the knot of said necktie.

14. A necktie knot support assembly for supporting a pre-tied knotted necktie, said assembly comprising:

a main body member shaped to determine formation of the knot of said necktie, said main body member having a substantially vertical central wall and a post rearwardly extending outwards from the wall at an acute angle therefrom, said acute angle being substantially between 60° and 80°, said main body member having first and second wings extending outward from the wall; and a spring clamp adapted to inter-engage said main body member, said spring clamp having a swingable clamp arm operatively swingable between an opened position and a closed position, said swingable clamp arm including first and second ends, said first end swingably coupled to said spring clamp at a position above said first and second wings.

15. The assembly of claim 14, wherein said second end of said swingable clamp arm is adapted to engage an outer end of said post in said closed position.

16. The assembly of claim 14, wherein said main body member has first and second wings extending outward and sloping downward from the wall.

17. A necktie knot support assembly for supporting a pre-tied knotted necktie, said assembly comprising:

a main body member shaped to determine formation of the knot of said necktie, said main body member having a substantially vertical central wall and a post rearwardly extending outwards from the wall at an acute angle therefrom, said acute angle being substantially between 60° and 80°, said main body member having first and second wings extending outward and sloping downward from the wall; and a spring clamp adapted to inter-engage said main body member, said spring clamp having a swingable clamp arm operatively swingable between an opened position and a closed position, said swingable clamp arm including first and second ends, said first end swingably coupled to said spring clamp at a position above said first and second wings.

18. A necktie knot support assembly for supporting a pre-tied knotted necktie, said assembly comprising:

a main body member shaped to determine formation of the knot of said necktie, said main body member having a substantially vertical central wall and a rear support member abridging across a rear surface of the wall, said rear support member including a notch adapted to receive a portion of said necktie so as to retain said necktie on said assembly; and a spring clamp adapted to inter-engage said main body member.

* * * * *